US009003860B2

(12) United States Patent
Keyaki et al.

(10) Patent No.: US 9,003,860 B2
(45) Date of Patent: Apr. 14, 2015

(54) MANUFACTURING APPARATUS FOR A SLIDE FASTENER SLIDER

(75) Inventors: Keiichi Keyaki, Toyama (JP); Shinya Honda, Toyama (JP)

(73) Assignee: YKK Corporation (JP)

( * ) Notice: Subject to any disclaimer, the term of this patent is extended or adjusted under 35 U.S.C. 154(b) by 159 days.

(21) Appl. No.: 13/518,411

(22) PCT Filed: Dec. 25, 2009

(86) PCT No.: PCT/JP2009/071683

§ 371 (c)(1),
(2), (4) Date: Jun. 22, 2012

(87) PCT Pub. No.: WO2011/077572

PCT Pub. Date: Jun. 30, 2011

(65) Prior Publication Data

US 2012/0255147 A1 Oct. 11, 2012

(51) Int. Cl.
*A44B 19/26* (2006.01)

(52) U.S. Cl.
CPC ..... *A44B 19/26* (2013.01); *A44B 19/262* (2013.01)

(58) Field of Classification Search
USPC ..... 72/414, 379.6; 24/431
See application file for complete search history.

(56) References Cited

U.S. PATENT DOCUMENTS

| | | | | |
|---|---|---|---|---|
| 2,018,948 | A * | 10/1935 | Corner | 24/424 |
| 2,299,846 | A | 10/1942 | Poux | |
| 4,974,297 | A * | 12/1990 | Akashi | 24/429 |
| 5,991,981 | A | 11/1999 | Komuro et al. | |
| 6,094,786 | A | 8/2000 | Wakabayashi | |
| 6,227,283 | B1 | 5/2001 | Wakabayashi | |
| 6,533,239 | B1 | 3/2003 | Komuro et al. | |

FOREIGN PATENT DOCUMENTS

| | | | |
|---|---|---|---|
| EP | 850577 | A2 | 7/1998 |
| EP | 906733 | A2 | 4/1999 |
| EP | 1279460 | A1 | 1/2003 |
| JP | 56-13200 | A | 2/1981 |
| JP | 62-009908 | U | 1/1987 |
| JP | 100836/1985 | | 1/1987 |
| JP | 2-19216 | | 2/1990 |
| JP | 2-12889 | | 4/1990 |
| JP | 9-1269 | A | 1/1997 |
| JP | 10-179216 | A | 7/1998 |
| JP | 11-89612 | A | 4/1999 |
| JP | 3087254 | | 5/2002 |
| JP | 3560118 | B | 6/2004 |

OTHER PUBLICATIONS

International Search Report and Written Opinion, PCT Internationai Application No. PCT/JP2009/071683, mailed Apr. 6, 2010.
Supplementary European Search Report, European Patent Application No. 09852587.6, mailed Nov. 22, 2013.
Office Action, Japanese Patent Application No. 2011-547181, May 13, 2014.

* cited by examiner

*Primary Examiner* — David B Jones
(74) *Attorney, Agent, or Firm* — Kilpatrick Townsend & Stockton LLP

(57) ABSTRACT

A slide fastener slider has a body including an upper wing, a lower wing and a coupling pillar mutually coupling the respective upper and lower wings. The slide fastener slider has been cast molded to have a configuration where the post to which a pull is attached extends over the upper wing substantially in parallel with the upper wing, and then a logo or a pattern or the like has been engraved on the upper surface of the post.

4 Claims, 5 Drawing Sheets

MANUFACTURING APPARATUS FOR A SLIDE FASTENER SLIDER

This application is a national stage application of PCT/W2009/071683 which is incorporated herein by reference.

TECHNICAL FIELD

The subject invention relates to a slide fastener slider and in more detail to a structure of a pull-attaching post for a slider.

BACKGROUND ART

A slide fastener slider has so-called body which is for separating and interlocking the fastener by mutually engaging or disengaging respective fastener elements of two fastener element (functioning tooth) rows inserted between its upper and lower wings. This body is configured such that so-called post, to which a pull for sliding the slider along the fastener element is attached, extends over the upper wing generally in parallel with the upper wing. The slider with such a fundamental configuration is disclosed by Japanese Patent No. 3560118, for example.

The post includes a configuration where its both ends are integrated to the body or a configuration where another end is a free end or the like. Typically, the post has a rectangular sectional face and has a lower surface opposing to the upper wing, an upper surface opposite to the lower surface, and side surfaces positioned left and right between that respective upper and lower surfaces. A space for allowing free slide movement of the pull is formed between the lower surface of the post and the upper surface of the upper wing of the body. The post has overall C-shape or arch-shape.

From past, engraving logos, patterns, other designs and the like on the post (hereinafter referred to as logo-engraving) has been widely conducted for improving the product brand recognition and its fanciness.

However, in past, when performing such logo-engraving, possible area the log can be engraved was restricted due to parting of cast molds. This is because, as described in Japanese Examined Utility Model Application Publication No. 2-12889, such a method is adopted that the body and the post of the slider is casted using the left and right cast molds to which logos and the like have been pre-engraved, and the logo is engraved at the end stage of the casting thereby product being manufactured.

On the other hand, when engraving the logos on an upper surface of the post, as described in Japanese Patent No. 3560118, a casting mold movable in vertical direction against the upper surface of the post is required in addition to cast molds movable in parallel direction against the respective upper and lower wings of the slider. Accordingly, such problems that not only increasing complexity and upsizing of the molding apparatus but also great decreasing in burst size per one molding apparatus have been invited.

For coping with that issues, in the Japanese Examined Utility Model Application Publication No. 2-12889, both side surface of the post of the body of the slider are sloped and the logos are engraved on each slope just using the left and right cast molds. However, in this method, the pattern-engraving on the upper surface of the post is not achievable, thereby disadvantageously deteriorating the flexibility of the logo-engraving on the surface of the post.

CITATION LIST

Patent Literature

[PTL 1] Japanese Patent No. 3560118
[PTL 2] Japanese Examined Utility Model Application Publication No. 2-12889

SUMMARY OF INVENTION

Technical Problem

This is to provide a slide fastener slider, its manufacturing method and manufacturing apparatus where the position of logos to be engraved is not confined due to parting of cast molds and further flexibility of logo-engraving on a surface of a post is not deteriorated.

Solution to Problem

According to one aspect of the subject invention, there is provided a slide fastener slider including: a body for engaging fastener elements; and a pull-attaching post integrated to the body, wherein a logo or a pattern or the like is engraved on an upper surface of the post.

According to another aspect of the subject invention, there is provided a manufacturing apparatus of a slide fastener slider that includes a body (18) for engaging fastener elements, a pull-attaching post (20) integrated to the body, and a logo or a pattern or the like (30) engraved on an upper surface of the post (20), the manufacturing apparatus including: engraving means (38) for engraving the logo or the pattern or the like (30) on the upper surface of the post (20) by pressing, the engraving means to be arranged over the upper surface (28) of the post (20).

The manufacturing apparatus may further include a holder that sandwiches both sides of the body of the slider to keep the posture of the body. The manufacturing apparatus may further include press load bearing means to be positioned to bear a press load from the engraving means and to be in contact with a lower surface of the post, the press load bearing means being integrated to the holder.

According to another aspect of the subject invention, there is provided a method for engraving a logo or a pattern or the like by pressing on an upper surface of a pull-attaching post that is integrated to a body that is for engaging fastener elements, the method including: placing, over the upper surface of the post, engraving means for engraving the logo or the pattern or the like on the upper surface of the post by pressing; holding the body by sandwiching both sides of the body by a holder; and engraving the logo or the pattern or the like on the upper surface of the post by the engraving means.

The method may further include providing press load bearing means to bear a press load from the engraving means and to be in contact with a lower surface of the post at the same time the body being held by a holder that sandwiches both sides of the body, the press load bearing means being integrated to the holder.

In each aspect of the subject invention, a parting line may not be formed in an area of the upper surface of the pull-attaching-post where the logo or the pattern or the like is engraved, and the parting line may be formed in the remaining area of the upper surface.

In each aspect of the subject invention, the logo or the pattern or the like on the upper surface of the pull-attaching-post may be engraved in an incised manner or a raised manner or the combination thereof.

In each aspect of the subject invention, the logo or the pattern or the like engraved on the upper surface of the post is raised by incising a predefined area outlining this engraved design.

In each aspect of the subject invention, the logo or the pattern or the like on the upper surface of the pull-attaching-post may be engraved not to overreach an area where the logo or the pattern or the like has not been engraved.

Advantageous Effects of Invention

There is provided a slide fastener slider, its manufacturing method and manufacturing apparatus where the position of logos to be engraved is not confined due to parting of cast molds and further flexibility of logo-engraving on a surface of a post is not deteriorated.

DESCRIPTION OF EMBODIMENTS

Figure 1:
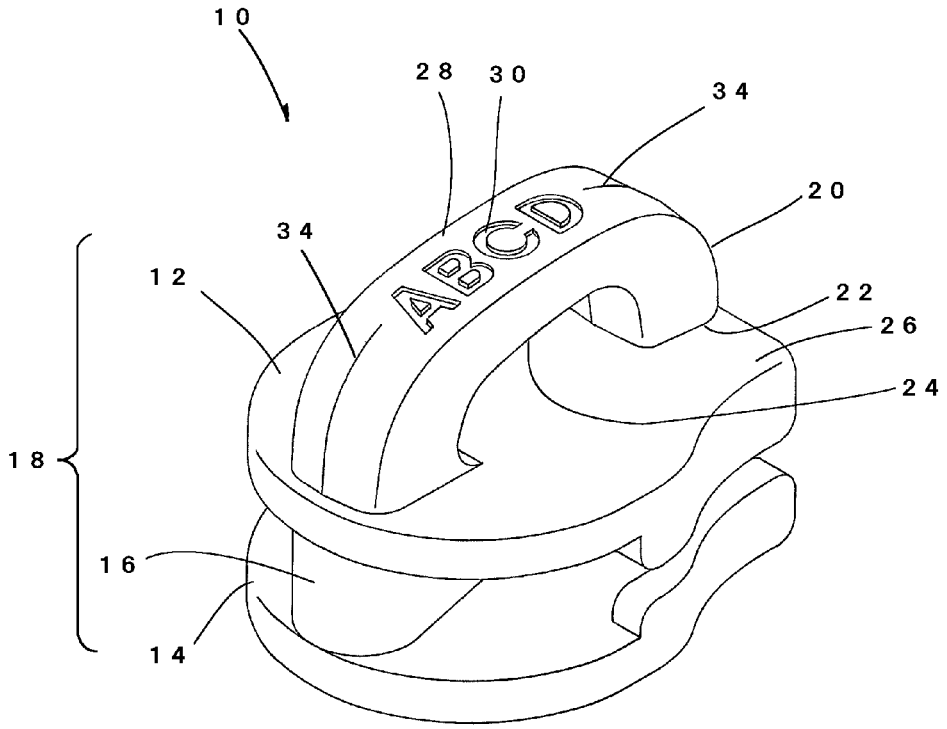
FIG. 1 is a perspective view of a slider to which a logo has been engraved on an upper surface of a pull-attaching-post according to the subject achievement.

Hereinafter, the subject achievement will be explained in detail with reference to the drawings. FIG. 1 shows a slide fastener slider to which numeral 10 has been assigned according to one aspect of the subject achievement. The slide fastener slider 10 has a body 18 including an upper wing 12 and a lower wing 14 for defining a path there-between to which unshown two fastener element (functioning tooth) rows are inserted for separating and interlocking a fastener, and a coupling pillar 16 mutually coupling that upper and lower wings 12, 14. A post 20, to which an undisclosed pull for sliding the slider 10 along the fastener elements is attached, protrudes from the body 18 and extends over the upper wing 12 substantially in parallel with the upper wing 12. The post 2 has a lower surface 24 opposing to the upper wing 12, an upper surface 26 positioned opposite to the lower surface 24, and both side surfaces 27 positioned left and right between that upper and lower surfaces.

In this embodiment, the post 20 has one end integrated to the body 18 and another end of a free end 22 that is not integrated to the body 18, and is configured to extend over the upper wing from a front end side to a rear end side of the body 18. It should be noted that figuration of the post 20 should not be limited by this embodiment, and such configurations may be adoptable that both ends of the post is integrated to the body, posts are provided at the upper side of the upper wing and the lower side of the lower wing, or the post straddles the front end of the body and is extended from the upper side of the upper wing to the upper side of the lower wing. Further, in this embodiment, a space for allowing the free slide movement of the pull is secured between the lower surface 24 of the post 20 and the upper surface 26 of the upper wing 12 of the body.

Further, a gap defined to prevent spontaneous disengagement of the pull is maintained between the free end 22 and the upper surface 26 of the upper wing 12 of the body 18, and the post 2 as a whole poses C-shape or arch-shape. In another embodiment, the both ends of the post 20 may be integrated to the body 18.

In the representative embodiment of the subject achievement shown in FIG. 1, the post 20 has, on its upper surface 28, a log or a pattern engraved as exemplary "ABCD" in FIG. 1. As explained earlier, such logo or pattern or the like is engraved at the same time the slider is casted and molded, and therefore the mold movable vertical to the upper surface 28 of the post 20 is necessarily additionally employed, resulting in that as explained earlier such problems have been invited that not only increasing complexity and upsizing of the molding apparatus but also great decreasing in burst size per one molding apparatus. Even though engraving patterns on the respective slopes using only left and right cast molds has been employed for dealing that issues, the pattern-engraving onto the upper surface, especially onto the top surface of the post is not achievable. Ultimately, such problems that flexibility of the pattern-engraving onto the surface of the post is disadvantageously deteriorated and so on have been invited.

In contrast, in the subject achievement, it has been discovered that such issues can be overcome by utilizing completely different step of logo-engraving comparing to the conventional manner. That is, the slide fastener slider 10 of the subject achievement has a body 18 including the upper wing 12, the lower wing 14 and the coupling pillar 16 mutually coupling the respective upper and lower wings 12, 14, and is cast molded to have a configuration where the post 20 to which the pull is attached extends over the upper wing 12 substantially in parallel with the upper wing 12, and then the logo or the pattern or the like 30 is engraved on the upper surface 28 of the post 20.

Figure 2:
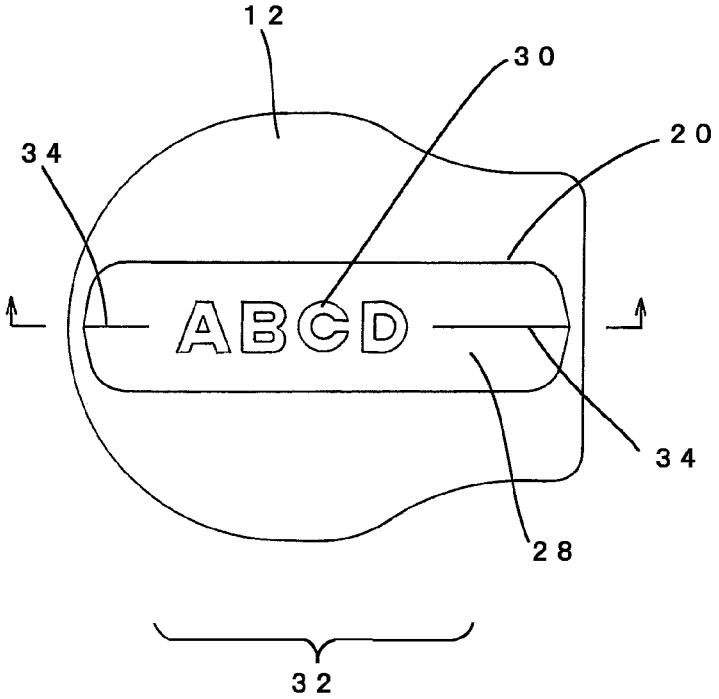
FIG. 2 is a plane view of the body of the slider of FIG. 1.

The logo-engraving is performed onto the slider 10 which has been cast molded as explained above, specifically onto the upper surface 28 of the post 20 in the embodiments of FIGS. 1 and 2. A logo-engraved area 32 (FIGS. 2 and 4) on the upper surface 28 of the post 20 has been flattened by a press load when engraving, and a parting line 34 has disappeared, thereby such effects may be obtained that the engraved logo or the pattern or the like 30 can be more easily observed and an appearance of a product can be improved.

Figure 9:
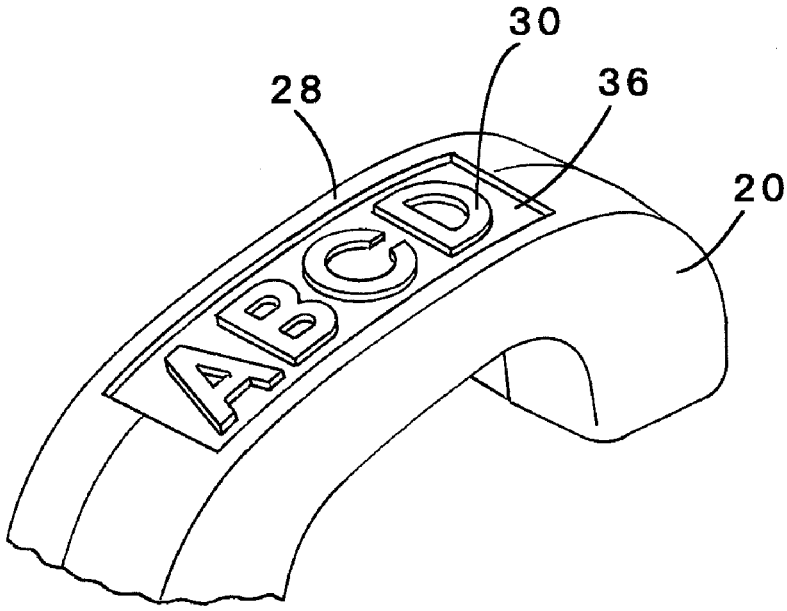
FIG. 9 is a perspective view exemplifying another embodiment where logo-engraving has been performed on an upper surface of a pull-attaching-post.

The logo or the pattern or the like on the upper surface 28 of the post 20 may be engraved in an incised manner, a raised manner, or the combination thereof according to an intended design. Since surface-treatment processing using barrel-polishing technique and so on may be performed on the body 18 after the logo-engraving, incising may be more preferable for preventing surface chippings of the logo or the pattern or the like 30 caused by the polishing. Alternatively, as shown in FIG. 9 for example, the logo or the pattern or the like 30 may be eventually raised after incising a predefined area 36 outlining the logo or the pattern or the like 30 to be engraved on the upper surface 28 of the post 20.

In order to prevent the surface chippings of the logo or the pattern or the like 30 by the above-described surface-treatment processing employing barrel-polishing technique and so on, the eventual height of that engraved logo or pattern or the like is advisably to be set not overreaching that surface area under any cases in which the logo or the pattern or the like 30 is incised on the upper surface 28 of the post 20 or the logo or the pattern or the like 30 is raised as a result of incising a predefined area 36 outlining the logo or the pattern or the like 30.

Figure 3:
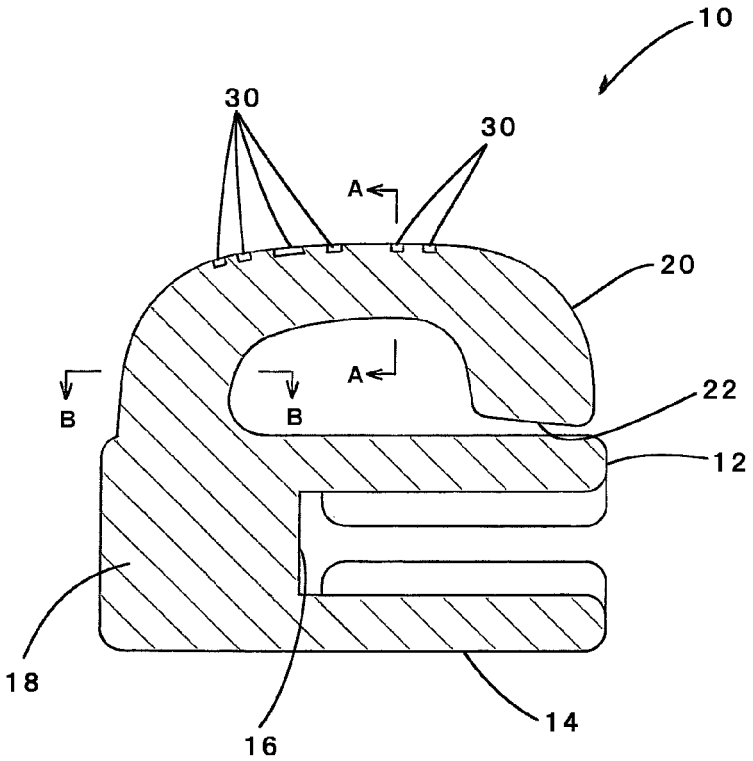
FIG. 3 is a sectional view of the body of the slider of FIGS. 1 and 2 taken along its lateral side.
Figure 4:
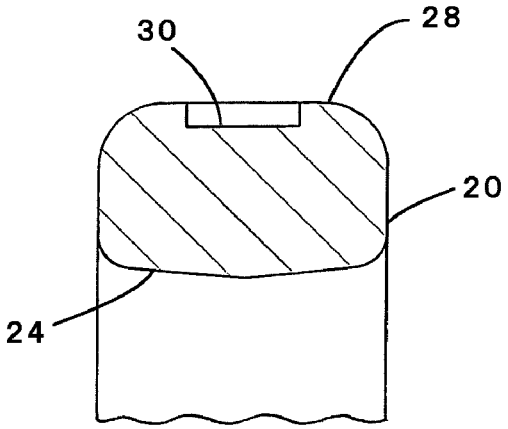
FIG. 4 is a sectional view of a part of the post taken along arrow A-A of FIG. 3 where the logo or the like has been engraved and no parting line has existed.
Figure 5:
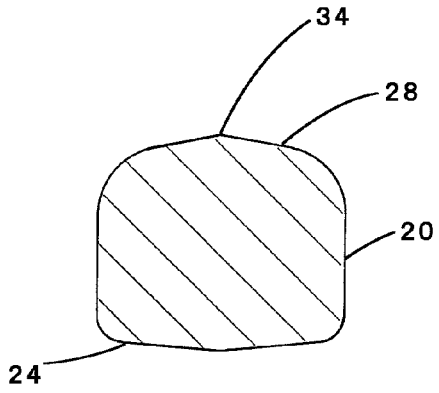
FIG. 5 is a sectional view of a part of the post taken along arrow B-B of FIG. 3 where the logo or the like has not been engraved and the parting line has remained.

FIG. 4 illustrates a sectional view of a portion taken along the line A-A in FIG. 3. The logo or the pattern or the like 30 engraved on the upper surface 28 of the post 20 is forming a recess as shown in the Figure. Across an area where continuous logos or patterns or the like 30 have been engraved, the parting line formed by a juncture of undisclosed two left and right cast molds has been flattened by the press load when engraving and has disappeared. On the other hand, FIG. 5 illustrates a sectional view of a portion of the post 20 with the upper surface taken along the line B-B of FIG. 3 which is closer to the coupling pillar 16. Since logo-engraving is not performed on that portion, no press load is applied onto that area where continuous logos or patterns or the like 30 are engraved, thereby ridge-shaped parting line 34, extending in the longitudinal direction of the post 20 having the upper surface and along that juncture of the cast molds, remains without change as shown in the upper central portion of FIG. 5.

Figure 6:
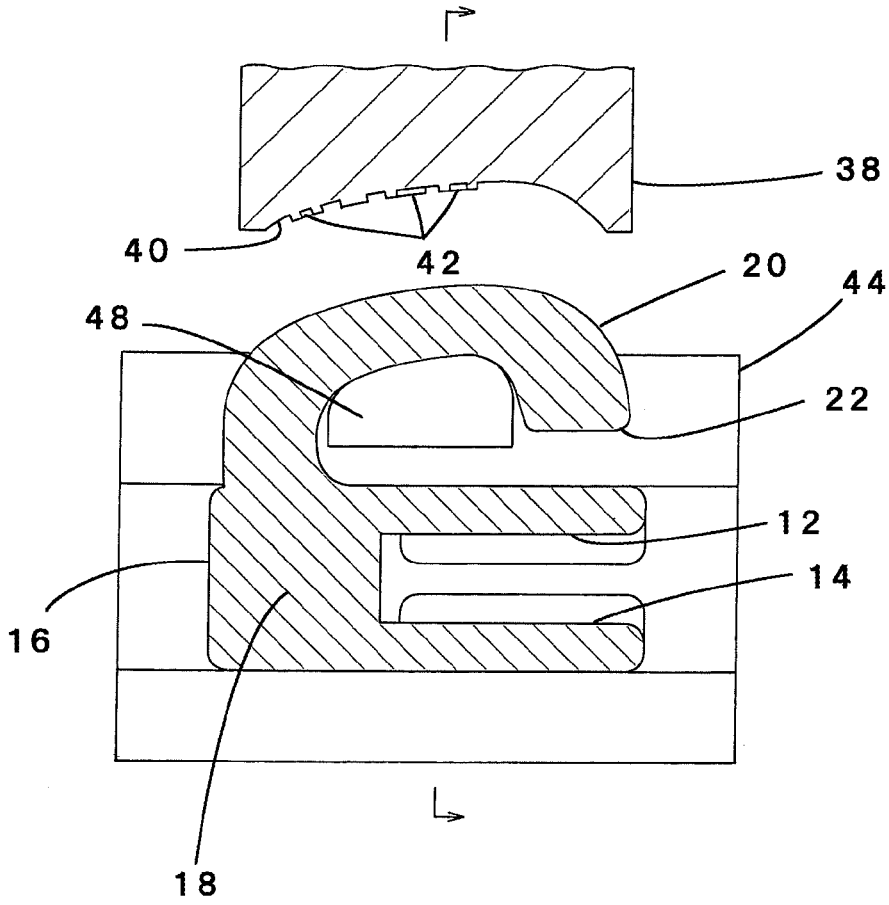
FIG. 6 is a sectional view taken along the lateral side before logo-engraving where a holder holds the slider and press load bearing means supports the post.

Hereinafter, the manufacturing apparatus and the manufacturing method of the subject application will be explained in detail with reference to FIGS. 6 to 8. FIG. 6 exemplifies a case where the slide fastener slider 10 has been positioned below logo-engraving pressing tool 38 for engraving the logo on the upper surface 28 of the post 20. The slide fastener slider 10 had been configured through cast molding such that the body 18 has the upper wing 12, the lower wing 14 and the coupling pillar 16 coupling the upper and lower wings 12, 14 and the pull-attaching post 20 extends over the upper wing 12 substantially in parallel with the upper wing 12.

The logo-engraving pressing tool 38 is a lettering punch where a logo or a pattern or the like has been engraved on its lower surface 40. An inversed logo/pattern/the like 42 has been engraved on that lower surface 40 according to an engrave-manner of the upper surface 28 of the post 20 of the slider 10, specifically an incised manner or a raised manner or the combination thereof. The slider 10 is positioned below the logo-engraving pressing tool 38 and the upper surface 28 of the post 20 is precisely positioned to face the logo or the pattern and the like 42 on the logo-engraving pressing tool 38. Next, as shown in FIGS. 6 and 7, the posture of the slider is secured by being pressed by two holders 44 at the respective side surface sides with respect to the longitudinal direction of the body 18 like a set box.

The respective holders 44 capable of approximating and separating are positioned to sandwich the body 18 from left and right, and have a base 44*a* for pushing the side surface of the body 18, an upper portion 44*b* extending in parallel with the upper surface 26 of the upper wing 12 and projecting from the upper end of the base 44*a*, and a lower portion 44*c* extending in parallel with the lower surface of the lower wing 14 and projecting from the lower end of the base 44*a*. Further when the side surface of the body is pushed by the base 44*a*, end faces of the respective upper portions 44*b* get closer to the side surfaces 27 of the post 20 and end faces of the respective lower portions 44*c* match with each other. The holder 44 not only pushes the respective side surfaces of the body 18 along its longitudinal direction but also may contact the upper surface 26 of the upper wing 12 and the lower surface 46 of the lower wing 14, thereby enhancing the posture maintenance as a result of vertically sandwiching the body 18. The holder 44 additionally includes a portion integrated to the holder 44 which is for contacting the lower surface 24 of the post 20 of the slider 10. This portion of the holder 44 works as a press load bearer 48. The press load bearers 48 protrude from the end faces of the respective upper portions 44*b*. When the end faces of the upper portions 44*b* get close to the side surface 27 of the post 20, that projecting end faces match with each other. The press load bearer 48 bears a portion of the press load applied to the upper surface 28 of the post 20 when the logo being engraved as explained below, minimizing an amount of the downward bending of the post 20, and thereby preventing breaking of the post 20 and enhancing accuracy of the logo-engraving.

Figure 7:
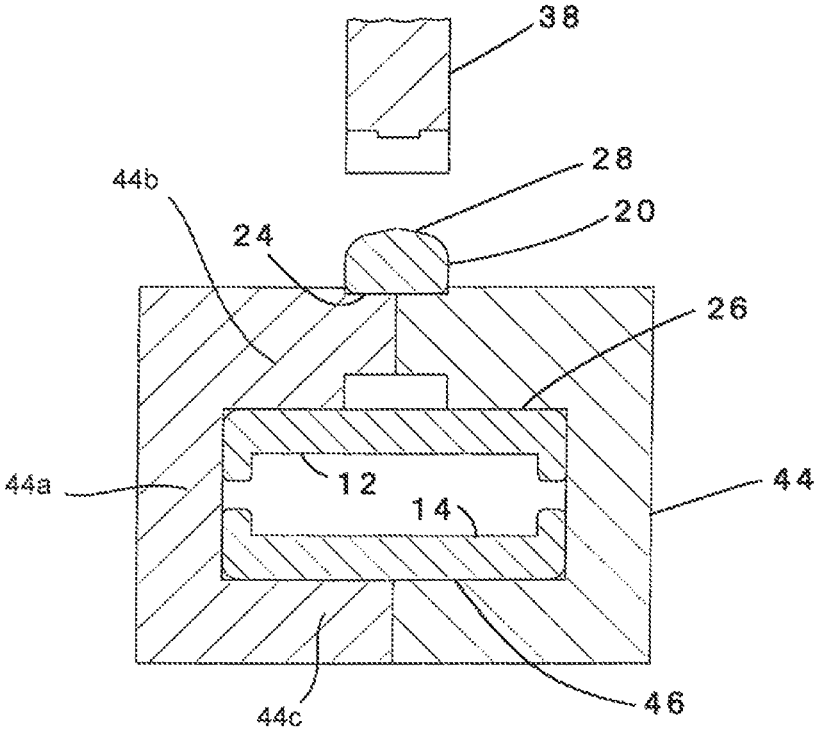
FIG. 7 is a sectional view taken along the front side before logo-engraving where the holder holds the slider and the press load bearing means supports the post.
Figure 8:
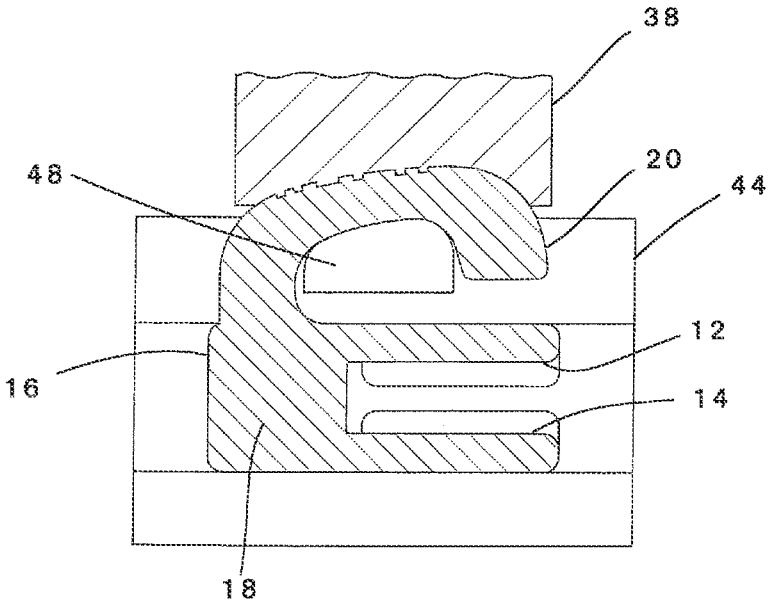
FIG. 8 is a sectional view of the slider taken along the lateral side when logo-engraving.

As shown in FIGS. 6 and 7, the position of slider 10 is held by the holder 44. After the press load bearer 48 contacts the lower surface 24 of the post 20, the logo-engraving pressing tool 38 is moved down as shown in FIG. 8, pressing the upper surface 28 of the post 20 of the slider 10 by the lower surface 40 of the logo-engraving pressing tool 38, thereby the inversed logo/pattern/the like 42 on that lower surface 40 being engraved on the upper surface 28 of the post 20. As explained above, at this moment, the press load bearer 48 of the holder bears via the post 20 a part of the press load applied to the upper surface 28 of the post 20, and thus the downward bending of the post 20 by the press load becomes less comparing to a case where no press load bearer 48 is provided, resulting in that not only the breaking of the post 20 is prevented but also the logo-engraving accuracy is enhanced by the decrease of vertical movement of the post 20.

FIG. 9 exemplifies another exemplary embodiment of the subject achievement. In the embodiment of FIG. 9, a predefined area 36 outlining the logo or the pattern or the like 30 on the upper surface 28 of the post 20 of the slider 10 is generally incised and the respective logo, pattern or the like 30 are consequently raised. In this case, the logo and the pattern and the like 38 inversely patterned on the lower surface 40 of the logo-engraving pressing tool 38 is configured to have a projection area corresponding to said area 36 and a depression area corresponding to the logo or the pattern or the like 30. Also in this case, in order to prevent the surface chipping of the logo or the pattern or the like 30 by the above-described surface treatment processing employing barrel-polishing technique and so on after the logo-engraving, the height of the logo or the pattern or the like 30 is set not to overreach an area of the upper surface 28 of the post 20 where that logo or pattern or the like 30 is not patterned.

Figure 10:
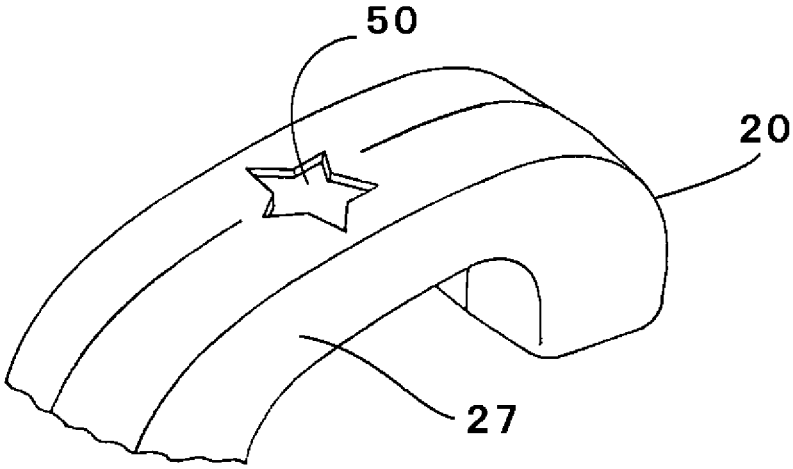
FIG. 10 is a perspective view exemplifying another embodiment where logo-engraving has been performed on an upper surface of a pull-attaching-post.

FIG. 10 exemplifies still another exemplary embodiment of the subject achievement. In this embodiment, the star-shaped pattern 50 is incised on the upper surface 28 of the post 20 of the slider 10.

While above explanations have been made with references to the specific embodiments, it should be recognized that various modifications can be achieved without departing from the scope of the subject invention.

REFERENCE SIGNS LIST

10 Slide fastener slider
12 Upper wing
14 Lower wing
16 Coupling pillar
18 Body

20 Post
22 Free end
24 Lower surface (of post)
27 Side surface (of post)
28 Upper surface (of post)
30 Logo or pattern or the like (of post upper surface)
32 Logo-engraving area (of post)
34 Parting line
38 Logo-engraving pressing means
40 Lower surface (of logo-engraving pressing means)
42 Logo or pattern or the like (inversely patterned on logo-engraving pressing means)
46 Lower surface of lower wing
44 Holder
48 Press load bearer of a holder
50 Star-shaped pattern (on the post upper surface)

The invention claimed is:

1. A manufacturing apparatus for a slide fastener slider that includes a body for engaging fastener elements, and a pull-attaching post coupled to the body, the manufacturing apparatus comprising:

an engraving tool configured to press an upper surface of the pull-attaching post so that a press load is applied to the upper surface of the pull-attaching post to form an engraved logo or pattern on the upper surface of the pull-attaching post, wherein the engraving tool is configured to be arranged over the upper surface of the pull-attaching post of the slide fastener slider after the slide fastener slider is shaped by a molding apparatus.

2. The manufacturing apparatus of claim 1, further comprising:

a holder that sandwiches both sides of the body of the slide fastener slider to keep a posture of the body.

3. The manufacturing apparatus of claim 2, wherein the holder further comprises a press load bearer to be positioned to bear the press load from the engraving tool and to be in contact with a lower surface of the pull-attaching post, the press load bearer being integrated with the holder.

4. The manufacturing apparatus of claim 1, wherein the upper surface of the pull-attaching post of the slide fastener slider has a parting line introduced when the slide fastener slider is shaped by the molding apparatus, and wherein the engraving tool is arranged such that the parting line on the upper surface partially disappears when the upper surface of the pull-attaching post is pressed by the engraving tool.

* * * * *

UNITED STATES PATENT AND TRADEMARK OFFICE

CERTIFICATE OF CORRECTION

PATENT NO. : 9,003,860 B2
APPLICATION NO. : 13/518411
DATED : April 14, 2015
INVENTOR(S) : Keiichi Keyaki et al.

It is certified that error appears in the above-identified patent and that said Letters Patent is hereby corrected as shown below:

On the title page item (56), in column 2, under "Other Publications", line 1, delete "Internationai" and insert -- International --, therefor.

In the specification,

In column 1, lines 5-6, delete "PCT/W2009/071683" and insert -- PCT/JP2009/071683 --, therefor.

Signed and Sealed this
Seventeenth Day of November, 2015

Michelle K. Lee

Michelle K. Lee
*Director of the United States Patent and Trademark Office*